US006227021B1

(12) United States Patent
Imanari

(10) Patent No.: US 6,227,021 B1
(45) Date of Patent: May 8, 2001

(54) CONTROL APPARATUS AND METHOD FOR A HOT ROLLING MILL

(75) Inventor: Hiroyuki Imanari, Chiba-ken (JP)

(73) Assignee: Kabushiki Kaisha Toshiba, Kanagawa-ken (JP)

( * ) Notice: Subject to any disclaimer, the term of this patent is extended or adjusted under 35 U.S.C. 154(b) by 0 days.

(21) Appl. No.: 09/551,548

(22) Filed: Apr. 18, 2000

(30) Foreign Application Priority Data

Apr. 27, 1999 (JP) ..... 11-118933

(51) Int. Cl.[7] ..... B21B 37/48

(52) U.S. Cl. ..... 72/12.3; 72/8.6; 72/8.9; 72/11.4; 72/11.8

(58) Field of Search ..... 72/8.6, 8.9, 9.1, 72/9.2, 11.4, 11.6, 11.7, 11.8, 12.3, 205, 365.2

(56) References Cited

U.S. PATENT DOCUMENTS 5,404,738 * 4/1995 Sekiguchi ..... 72/11.4
5,479,803 * 1/1996 Imanari ..... 72/8.6
5,495,735 * 3/1996 Nishimura ..... 72/11.8
5,740,686 * 4/1998 Martinetz et al. ..... 72/11.6
5,809,817 * 9/1998 Ginzburg ..... 72/11.4

FOREIGN PATENT DOCUMENTS 7-178427 7/1995 (JP) .
8-192210 7/1996 (JP) .

* cited by examiner

*Primary Examiner*—Ed Tolan
(74) *Attorney, Agent, or Firm*—Foley & Lardner

(57) ABSTRACT

A control apparatus for a hot rolling mill having a plurality of rolling stands, including a roll gap tension controller configured to control a roll gap of one of the rolling stands so that a detected interstand tension value of a rolled material positioned between the adjacent rolling stands accords with a target interstand tension value thereof; and a tension width controller configured to control a width of the rolled material by correcting the target interstand tension value.

17 Claims, 7 Drawing Sheets

CONTROL APPARATUS AND METHOD FOR A HOT ROLLING MILL

CROSS REFERENCE TO RELATED APPLICATION

This application claims benefit of priority to Japanese Patent Application No. 11-118933 filed Apr. 27, 1999, the entire content of which is incorporated by reference herein.

BACKGROUND OF THE INVENTION

1. Field of the Invention

This invention relates to a control apparatus for a tandem type of a hot rolling mill including a plurality of rolling stands, which controls a width of a rolled material by controlling an interstand tension of the rolled material positioned between adjacent rolling stands.

2. Description of the Background

As for finishing hot rolling mills, to obtain a desired thickness and width of a rolled material, a control apparatus for the finishing hot rolling mill is initialized by calculating a roll gap between rolls of a rolling stand and a rolling speed in accordance with rolling conditions and the properties of the rolled material.

FIGS. 1 and 2 show one example of a conventional control apparatus for a finishing hot rolling mill. FIGS. 1 and 2 share a drawing of the control apparatus and show it in cooperation.

A finishing hot rolling mill is shown in FIGS. 1 and 2, which usually includes four through seven rolling stands disposed in tandem.

FIGS. 1 and 2 also show a rolled material 1, rolling stands 2(2*a*~2*e*), load detectors 3(3*a*~3*e*) such as load cell, rolling motors 4(4*a*~4*e*) for driving rolls, speed controllers 5(5*a*~5*e*), loopers 6(6*a*~6*d*) controlling an interstand tension of the rolled material 1 positioned between adjacent rolling stands 2, tension detectors 7(7*a*~7*d*) attached to the loopers 6, and roll gap controllers 8(8*a*~8*e*).

A delivery side width gauge 9 is disposed at the delivery side of a roughing rolling mill positioned at the entry side of the finishing hot rolling mill. An entry side pyrometer 10 measures a temperature of the rolled material 1 which is needed for calculating the initial value for the finishing hot rolling mill. Further, a delivery side width gauge 11, a delivery side pyrometer 12 and a delivery side thickness gauge 20 are disposed at the delivery side of the finishing hot rolling mill in order to check the qualities of the product.

In rare cases, a thickness gauge and a width gauge are respectively disposed between the rolling stands 2, thereby measuring the thickness and width of the rolled material 1 on all the way of the rolling process and using them for setting or controlling. Such system is rarely adopted and it makes a difference in a control system whether the thickness gauge and the width gauge are respectively disposed between the rolling stands 2 or not. The following is the conventional control apparatus as shown in FIGS. 1 and 2, which can be easily modified, even if the thickness gauge and the width gauge are disposed between the rolling stands 2.

In FIGS. 1 and 2, a setter 19 calculates a roll gap and a rolling speed of each roll of the rolling stands 2 in accordance with rolling conditions and target values of a thickness and a width of the rolled material 1, and sets the roll gap and the rolling speed to a subordinate controller, that is, the roll gap controllers 8 and the speed controllers 5.

Looper tension controllers 14(14*a*~14*d*) input each looper angle formed by a looper arm supporting each of the loopers 6 and a horizontal line, and each interstand tension detected by each of the tension detectors 7, thereby calculating and outputting correcting speeds for the rolling motors 4, which are used for obtaining target tension values and target looper angle values.

Power source for revolving the loopers 6 may be looper electric motors, looper hydraulic cylinders or looper hydraulic motors, but whether which power source is adopted is not cared at this point. Command values of the power sources may be command values of torque(current) or speed in case electric motors are adopted as the power sources. Command values for the power sources may be command values of torque or pressure in case hydraulic power is adopted as the power sources. In FIGS. 1 and 2, drawings of the power sources are omitted.

A roll gap thickness controller 16 respectively outputs roll gap command values to the roll gap controllers 8 by feeding back a detected thickness value measured by a delivery side thickness gauge 20 so that a thickness of the rolled material 1 accords with the target value thereof. In some cases, a thickness control is executed by using a gauge meter thickness calculated on the basis of gauge meter equation, that is, the gauge meter thickness is calculated on the basis of roll forces detected by load detectors 3 and roll gap command values.

The gauge meter equation is represented as follows:

$$h=S+P/M$$

h is a delivery side thickness of a rolled material. S is a roll gap command value. P is a roll force. M is a mill modulus.

The above is a basic control system for the finishing hot rolling mill, but a width control for a rolled material is sometimes added to the above described system.

Each target value of interstand tensions is calculated on the basis of a difference between a width value detected by the delivery side width gauge 11 and a target width value thereof, and is then sent to each of the looper tension controllers 14. This control method is so-called an FB (Feed Back) control.

Further, an FF (Feed Forward) control may be used for reducing a width of the rolled material 1 by means of tracking a width detected by the delivery side width gauge 9 with the progress of the rolled material 1 and providing a large tension at the wide width portion of the rolled material 1 during the rolling process.

As for a usual width behavior of the rolled material 1, as an interstand tension becomes larger, a width of the rolled material 1 reduces. Further, as a temperature of the rolled material 1 becomes higher, an effect on a width variation of the rolled material 1 becomes larger. Consequently, either an FB control or an FF control takes account of a relation with the width variation, an interstand tension and a temperature.

Either the FB control or the FF control is integrated into a conventional tension thickness controller 21 shown in FIG. 2. A roll gap variation of the rolling stand 2, which is regarded as a disturbance against a width control other than a width variation produced at a roughing rolling mill, may take an effect on a width change of the rolled material 1. In case a roll gap is reduced by the rolling stand 2, a width of the rolled material 1 spreads. On the contrary, in case a roll gap is opened by the rolling stand 2, a width of the rolled material 1 becomes narrow. Generally speaking, a final width of a delivery side width of the rolled material 1 is determined by combining a width spreading effect at the point just below the rolling stand 2 with a width narrowing effect at the middle of the adjacent rolling stands 2.

The most upstream stand 2*a* has a large effect on spreading a width of the rolled material 1, since a reduction at the rolling stand 2*a* is usually big. Accordingly, if the rolling stand 2*a* changes a roll gap by use of the AGC (Automatic Gauge Control), the width variation becomes larger.

As described above, in case an interstand tension is changed to control a width of the rolled material 1, this change results in not only a variation of the width but also a variation of the thickness thereof. That is, if the interstand tension increases, the thickness thins. If the interstand tension decreases, the thickness becomes thick. Especially, if an interstand tension is changed at the most downstream stand 2*e*, this change has a big effect on a thickness of the rolled material 1.

Accordingly, it is impractical to correct a width in a large quantity by changing an interstand tension. An ability of a width control is limited at the most downstream stand 2*e*. In practical, such tension width control is applied to the rolling stands 2 disposed at the upstream side.

However, there is a problem in the present tension width control.

For example, if an interstand tension is increased to narrow a width of the rolled material 1, a roll force and a mill stretch decrease. As a result of which, a thickness of the rolled material 1 becomes thin, a roll gap of the rolling stand 2 becomes small by the AGC, and a width of the rolled material 1 is widen at the point just below the rolling stand 2. Consequently, a width narrowing effect controlled by a tension change is almost canceled in part by a width spreading effect due to a decrease in a roll gap. Therefore, to control a width of the rolled material 1 so as to accord with a target width, much more tension is required.

Further, in general, a response of a tension change by means of a looper control takes 1 second to reach a 95 percent of the reference value. Since it usually takes about three times as much as the time until a width control is finished, a quicker response is desired.

SUMMARY OF THE INVENTION

Accordingly, one object of this invention is to provide a control apparatus and a method for a hot rolling mill which implements a width control by means of a tension control executed by a roll gap controller capable of a quick response so that an influence of a width variation caused by a tension change cooperates with an influence of a width variation caused by a roll gap change.

The present invention provides a control apparatus for a hot rolling mill having a plurality of rolling stands, including a roll gap tension controller configured to control a roll gap of one of the rolling stands so that a detected interstand tension value of a rolled material positioned between the adjacent rolling stands accords with a target interstand tension value thereof; and a tension width controller configured to control a width of the rolled material by correcting the target interstand tension value.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
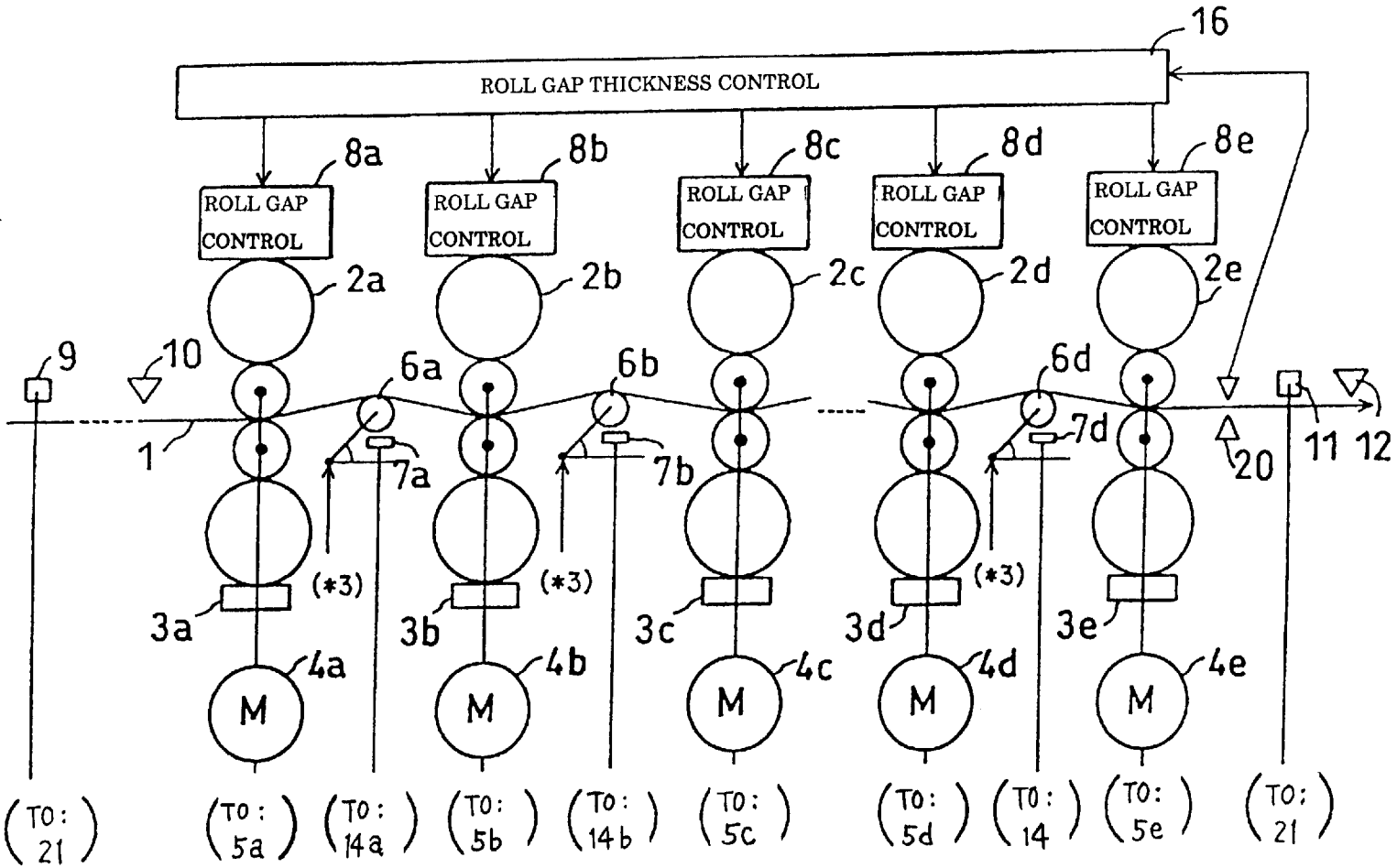
FIG. 1 (PRIOR ART)
FIG. 1 is a block diagram of one example of a conventional control apparatus for a hot rolling mill.
Figure 2:
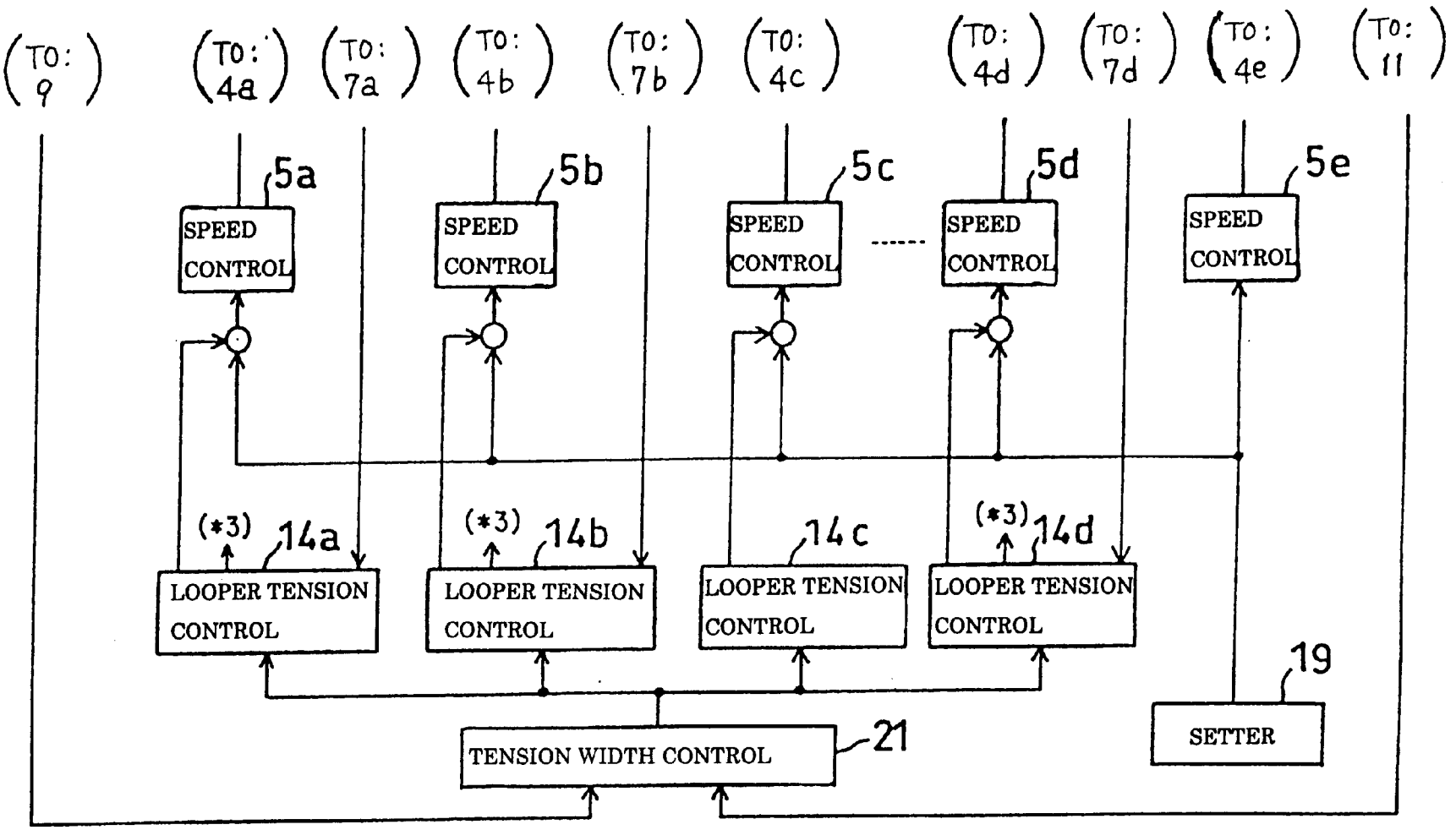
FIG. 2(PRIOR ART)
FIG. 2 is a block diagram of one example of a conventional control apparatus for a hot rolling mill.

Referring now to the drawings, wherein like reference numerals designate identical or corresponding parts throughout the several views, the embodiment of the present invention is described below.

The present invention will hereinafter be described in detail by way of an illustrative embodiment.

Figure 3:
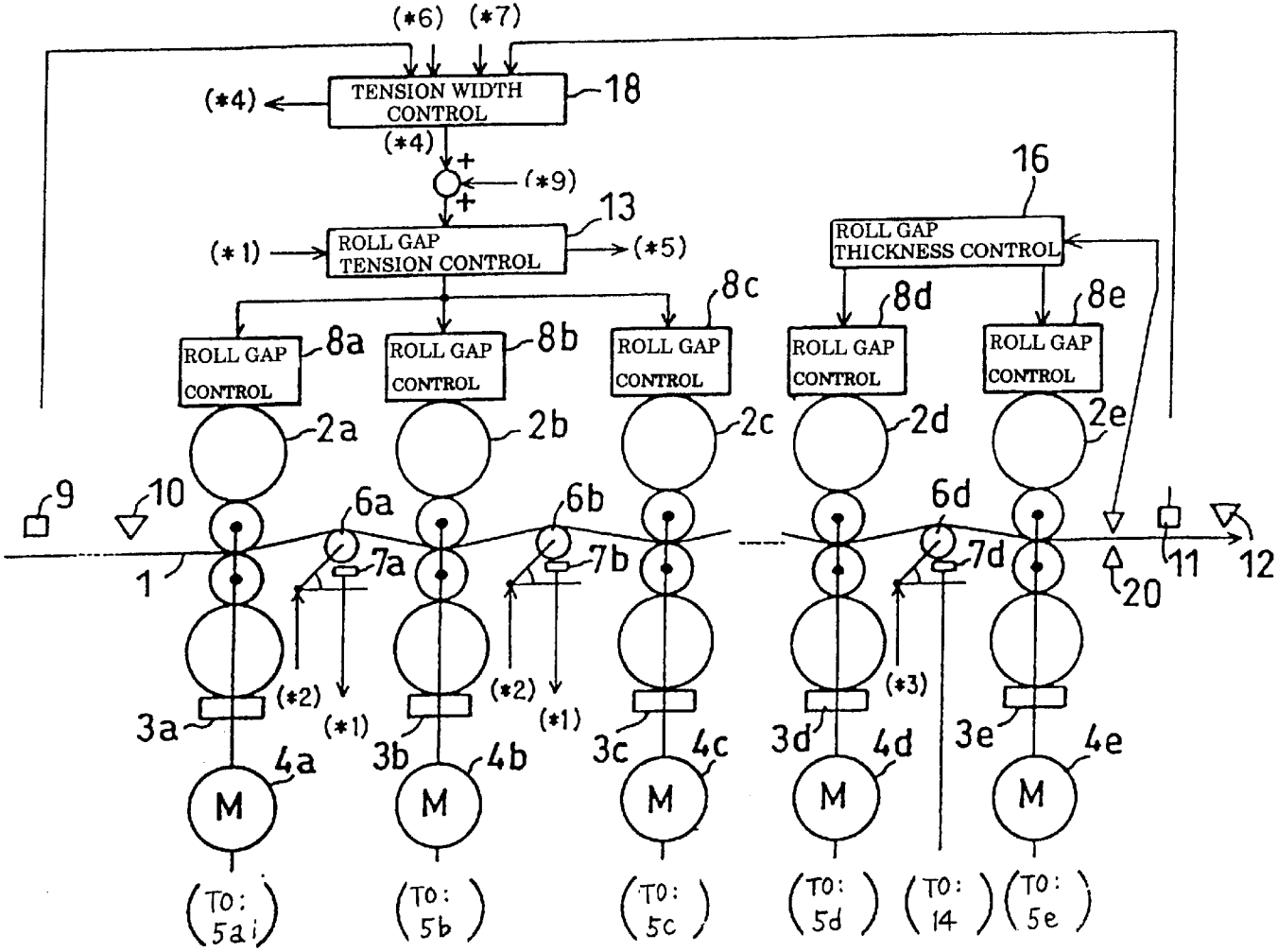
FIG. 3 is a block diagram of a control apparatus for a tandem type of a hot rolling mill.
Figure 4:
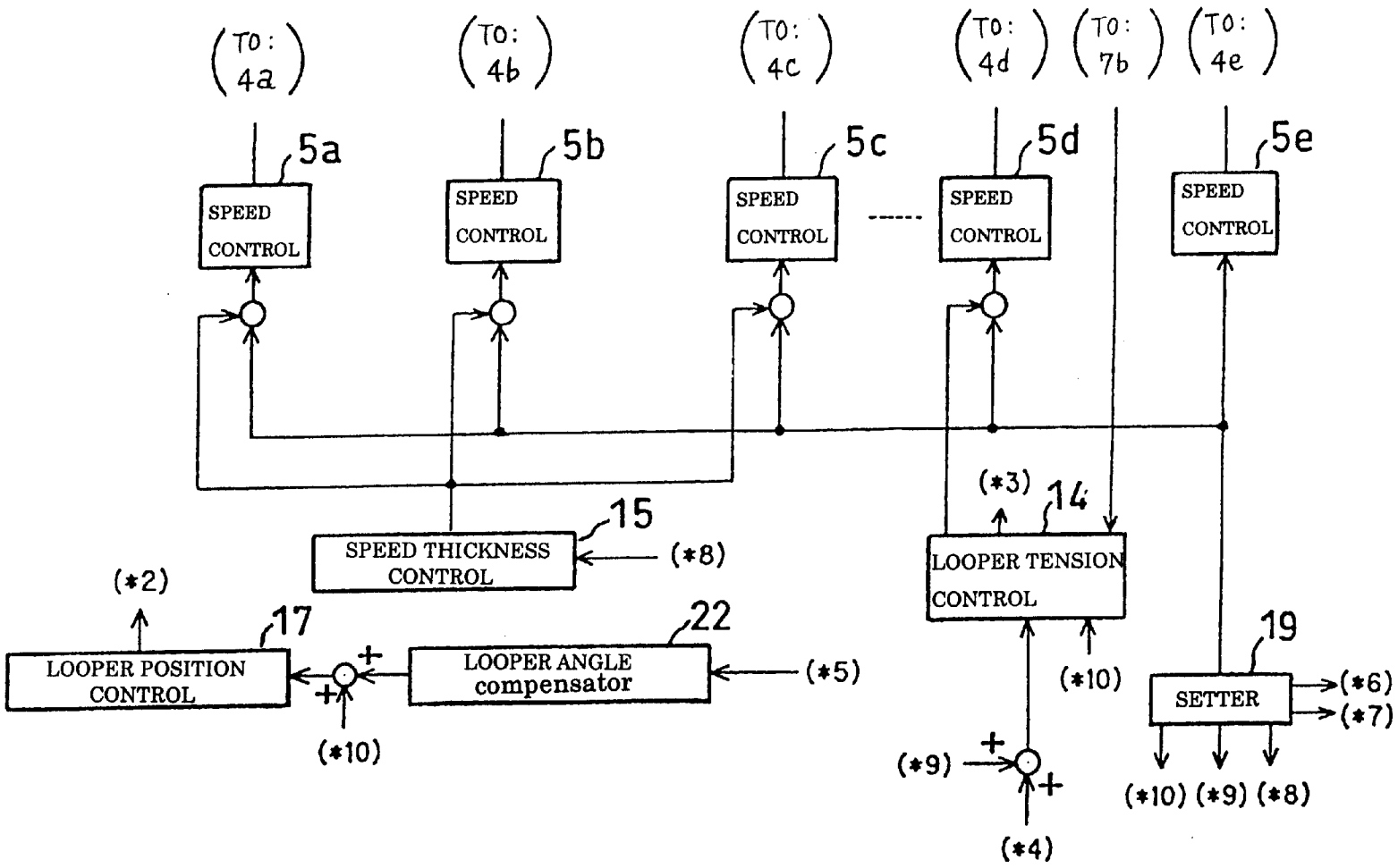
FIG. 4 is a block diagram of a control apparatus for a tandem type of a hot rolling mill.

FIGS. 3 and 4 share a drawing of a control apparatus for a finishing hot rolling mill and show it in cooperation.

A setter 19 in FIG. 4 determines a target width value (*6,*7 in FIG. 4), a target thickness value (*8 in FIG. 4), a target interstand tension value (*9 in FIG. 4) of a rolled material 1, a target looper angle value (*10 in FIG. 4) and a rolling speed by the time the rolled material 1 reaches the finishing hot rolling mill, and sets them to a subordinate controller, that is, a tension width controller 18, a roll gap tension controller 13, a speed thickness controller 15, a looper tension controller 14, a looper position controller 17 and speed controllers 5(5*a*~5*e*).

The tension width controller 18 inputs a first width value measured by a delivery side width gauge 9 and a second width value measured by a delivery side width gauge 11 and calculates a correction tension value so that the second width value accords with the target width value set by the setter 19. An interstand tension command value, which is an added value of the correction tension value and the target interstand tension value set by the setter 19, is output to the roll gap tension controller 13.

The roll gap tension controller 13 inputs an interstand tension value, which is a tension value of the rolled material 1 positioned between adjacent rolling stands 2, detected by tension detectors 7(7*a*~7*d*), and then determines a roll gap command value so that the interstand tension value accords with the interstand tension command value. That is, the roll gap tension controller 13 controls an interstand tension value of the rolled material 1 by providing the roll gap command value to roll gap controllers 8.

In case loopers 6(6*a*~6*d*) are respectively disposed between adjacent rolling stands 2, the looper position controller 17 controls the loopers 6 so that each looper angle accords with the target looper angle.

To improve a response of an interstand tension control, a looper angle compensator 22 calculates a looper angle to be compensated on the basis of a difference between a detected interstand tension value and the tension command value thereof, and then provides the looper angle to the looper position controller 17.

The following is an explanation of the operation of this embodiment.

An interstand tension is generally controlled by the rolling stand 2 disposed at the downstream side. For example, to control an interstand tension between the rolling stands 2*a* and 2*b*, the stand 2*b* is usually used for an interstand tension control. Because, the downstream stand 2*b* has a large effect on an interstand tension of the rolled material 1, although the stand 2*a* has some effect on an interstand tension of the rolled material 1. An interstand tension between the rolling stands 2*a* and 2*b* is made a higher tension by opening a roll gap of the stand 2*b*, while the interstand tension is made a lower tension by closing a roll gap of the stand 2*b*.

In case of narrowing a width of the rolled material 1, a roll gap is opened in order to make an interstand tension higher. By opening a roll gap, the rolled material 1 is prevented from widening at the point just below the rolling stand 2. Therefore, a control direction of an interstand tension accords with a control direction of a roll gap with respect to a width variation.

In case each of the roll gap controllers 8 is consisted of hydraulic components, a response of the roll gap controller 8, which is cross over frequency ωc, is generally about 60~120rad/s (a time constant: 16.7~8.3 msec). This is about five times as quick as a response of electric motors. Therefore, when an interstand tension control is needed for the rolled material 1, the roll gap controllers 8 may obtain a quicker tension control response compared with the looper tension controllers 14.

Figure 5:
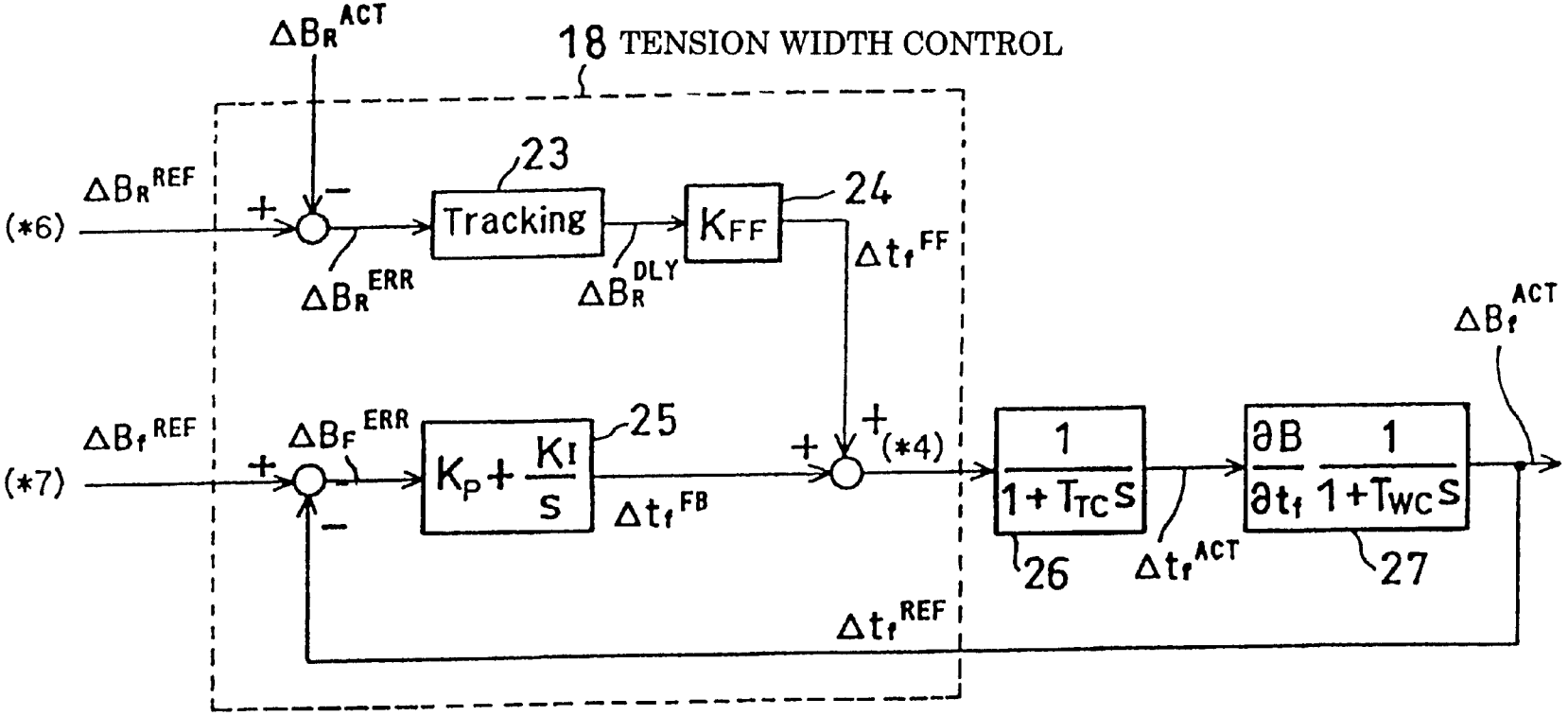
FIG. 5 is a detailed block diagram of a tension width controller 18.

FIG. 5 shows a detailed block diagram of a tension width controller 18.

In FIG. 5, the tension width controller 18 is composed of a tracking circuit 23, a FF (Feed Forward) controller 24 and a FB (Feed Back) controller 25. The block 26 is a tension control system 26. The block 27 is a width modulation system 27. Further, $K_{FF}$ is a FF (Feed Forward) gain, $K_P$ is a proportional gain, $K_I$ is an integral gain, $T_{TC}$ is a time constant of a response with respect to a tension control, $\partial B/\partial t_f$ is an influence coefficient of a width change of the rolled material 1 with respect to an interstand tension of the rolled material 1, $T_{WC}$ is a time constant of a response with respect to a width variation, and s is a Laplace operator.

The tracking circuit 23 tracks a difference $\Delta B_R^{ERR}$ between a delivery side width value $\Delta B_R^{ACT}$ measured by the delivery side width gauge 9 and a delivery side target width value $\Delta B_R^{REF}$ set by the setter 19, and then outputs a difference $\Delta B_R^{DLY}$ which is a presumed difference at the time the rolled material 1 reaches at the point just below the rolling stand 2. The FF controller 24 produces a tension modification value $\Delta t_f^{FF}$ of a FF control by multiplying the difference $\Delta B_R^{DLY}$ by the FF gain $K_{FF}$.

The FB controller 25 calculates a tension modification value $\Delta t_f^{FB}$ of a FB control on the basis of a difference $\Delta B_f^{ERR}$ between a delivery side width value $\Delta B_f^{ACT}$ detected by the delivery side width gauge 11 and a delivery side target width value $\Delta B_f^{REF}$ set by the setter 19.

A tension correction value $\Delta t_f^{REF}$ is calculated by adding the tension modification value $\Delta t_f^{FF}$ and the tension modification value $\Delta t_f^{FB}$, and is provided to a subordinate controller, that is, the tension control system 26 composed of a roll gap tension controller 13, the roll gap controllers 8 and the rolling stands 2, whereby a width of the rolled material 1, which is a target to be controlled, is corrected in the width modulation system 27.

Figure 6:
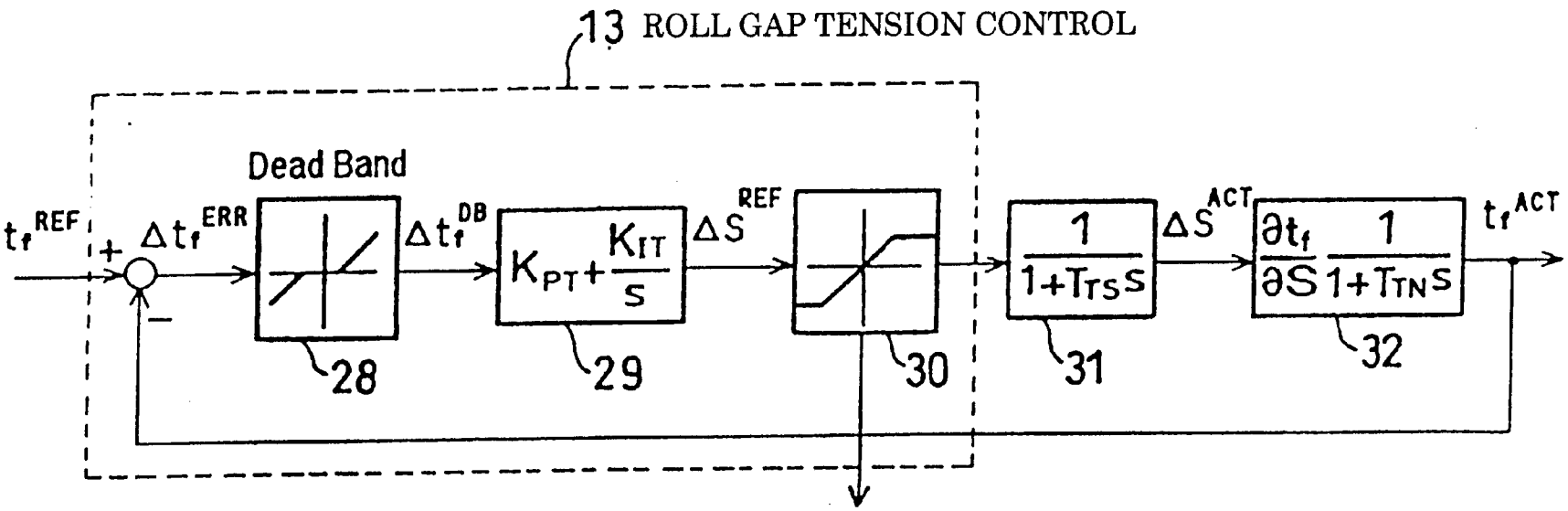
FIG. 6 is a detailed block diagram of a roll gap tension controller 13.

FIG. 6 shows a detailed block diagram of the roll gap tension controller 13.

In FIG. 6, the roll gap tension controller 13 is composed of a dead band 28, a FB (Feed Back) controller 29 and a limiter 30. The block 31 is a roll gap control system. The block 32 is a tension generation system 32. Further, $K_{PT}$ is a proportional gain, $K_{IT}$ is an integral gain, $T_{TS}$ is a time constant of a response with respect to a reduction control, $\partial t_f/\partial S$ is an influence coefficient of an interstand tension of the rolled material 1 with respect to a roll gap of the rolling stand 2, $T_{TN}$ is a time constant of a response with respect to a tension, and s is a Laplace operator.

The dead band 28 is added for not producing an excessive response in accordance with the difference $\Delta t_f^{ERR}$ between an interstand tension value $t_f^{ACT}$ detected by a tension detector 7, and an interstand tension command value $t_f^{REF}$ which is an added value of a target interstand tension value $t_f^{AIM}$ and the tension correction value $\Delta t_f^{REF}$. However, if a width of the dead band 28 is broadened excessively, a tension control does not work well. An output of the dead band 28, that is a difference $\Delta t_f^{DB}$, is provided to the FB controller 29. The FB controller 29 calculates a roll gap correction value $\Delta S^{REF}$. The roll gap correction value $\Delta S^{REF}$ is provided to a subordinate controller which is the roll gap control system 31 composed of the roll gap controllers 8 and the rolling stands 2 after a limiting process of the limiter 30. The roll gap control system 31 calculates a roll gap variation value $\Delta S^{ACT}$ which changes an interstand tension of the rolled material 1 by causing a movement of a neutral point in a roll bite and then changing a forward slip or a backward slip.

As shown in FIG. 3, the roll gap tension controller 13 is disposed at the upstream side of the finishing hot rolling mill. If an interstand tension is changed at the downstream side of the finishing hot rolling mill, such change has a large effect on a thickness of the rolled material 1. Therefore, it is preferable to perform a width control by means of disposing the roll gap tension controller 13 at the upstream side of the finishing hot rolling mill, which side has less effect on a thickness of the rolled material 1.

On the other hand, as to a thickness control, where the tension width controller 18 is disposed at the only upstream stands 2, a thickness precision may be achieved by a thickness control at the downstream stands 2. Because, an ability of the thickness control may not be high, in case the thickness control is executed at the upstream stands 2 of the finishing hot rolling mill.

To achieve a preferable thickness precision, a thickness of the rolled material 1 may be controlled by changing a roll revolving speed of the rolling stands 2 in accordance with an operation of a speed of the rolling motors 4. A thickness of the rolled material 1 at the point just below the rolling stand 2 is measured or presumed, and then fed back for a FB control. If the measured or presumed thickness value is higher than a target thickness value, a speed of the rolling motor 4 is reduced. On the contrary, if the measured or presumed thickness value is lower than a target thickness value, a speed of the rolling motor 4 is increased.

Figure 7:
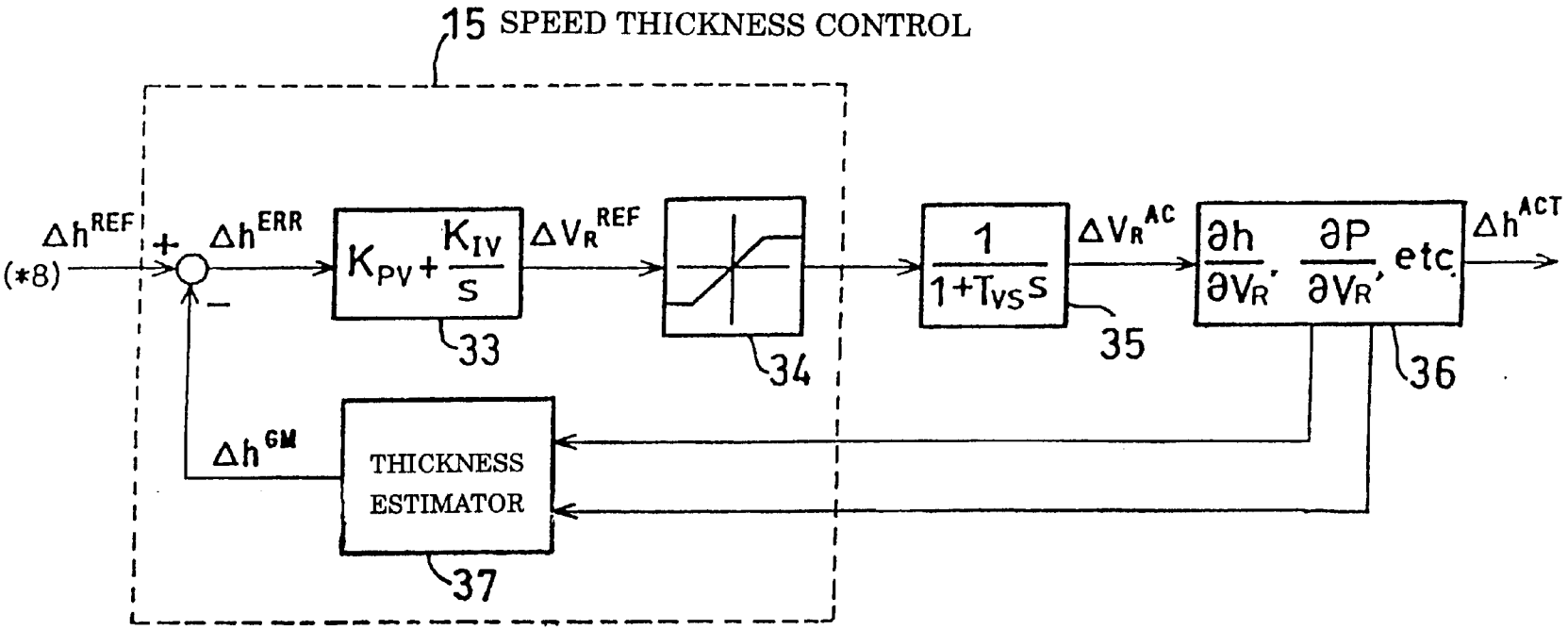
FIG. 7 is a detailed block diagram of a speed thickness controller 15.

FIG. 7 shows a detailed block diagram of the speed thickness controller 15.

The speed thickness controller 15 is composed of a FB (Feed Back) controller 33, a limiter 34 and a thickness estimator 37. The block 35 is a speed control system. The block 36 is a rolling process. Further, $K_{PV}$ is a proportional gain, $K_{IV}$ is an integral gain, $T_{VS}$ is a time constant of a response with respect to a roll gap control, $\partial h/\partial V_R$ is an influence coefficient of a thickness of the rolled material 1 with respect to a rolling speed of the rolling stand 2, $\partial P/\partial V_R$ is an influence coefficient of a roll force of the rolling stand 2 with respect to a rolling speed of the rolling stand 2, and s is a Laplace operator.

The FB controller 33 inputs a thickness difference $\Delta h^{ERR}$ between a presumed thickness value $\Delta h^{GM}$ and a target thickness value $\Delta h^{REF}$ (*8) set by the setter 19, and calculates a speed correction value $\Delta V_R^{REF}$ so that the thickness difference $\Delta h^{ERR}$ reaches zero. The limiter 34 performs a limiting process so as not to cause an excessive response and then forwards the speed correction value $\Delta V_R^{REF}$ to the speed control system 35 including the speed controller 5*b* of the rolling motor 4. Due to a speed change of the rolling motor 4, a thickness change of the rolled material 1 and a roll force change of the rolling stand 2 are generated within the rolling process 36. The thickness estimator 37 presumes a delivery side thickness value of the rolled material 1 on the basis of a roll force detected by the load detector 3, a roll gap of the rolling stand 2 and the like by means of the gauge meter equation. A width control, a thickness control and an interstand tension control can be executed well at the upstream side of the finishing hot rolling mill by combining the speed thickness controller 15 and the tension width controller 18.

If a roll gap of the rolling stand 2*a* disposed at the most upstream side of the finishing hot rolling mill is excessively changed, a width variation is also changed on a large scale, thereby disturbing a width control. Therefore, such disturbance with respect to the width control may be removed by keeping the roll gap of the rolling stand 2*a* constant. It is preferable for a thickness presumption to keep the roll gap of the rolling stand 2*a* constant. Because, a nonlinear factor such as a hysteresis and a backlash may be eliminated, and further, a roll force change represents a temperature change and a thickness change of the rolled material 1 themselves. Since the precise thickness presumption is performed at the upstream side of the finishing hot rolling mill and the presumed thickness value is provided to the downstream rolling stands 2, a precision of a thickness presumption at the downstream rolling stands 2 may be improved. Where a roll gap of the rolling stand 2*a* disposed at the most upstream side of the finishing hot rolling mill is kept constant, the roll gap tension controller performs a width control by using the rolling stands 2*b* and 2*c*. Where the loopers 6 are respectively disposed at the intermediate positions between the rolling stands 2, each looper angle is controlled to be constant, thereby preventing from causing a tension change due to an up-and-down motion of the loopers 6.

Although the roll gap tension controller 13 controls a roll gap of each rolling stand 2, but, in some cases, it is not preferable to change a roll gap in a large way. Therefore, the limiter 30 is added.

The looper angle compensator 22 changes a looper angle so as to support an excess amount of tension over a limit of the limiter 30, only if the limiter 30 actually executes a limiting action.

The looper angle to be changed can be given by the following formulas:

(In case of over limit)

$$\Delta\theta = K_{SL}(\partial\theta/\partial S)|S^{REF} - S^{LMT}|$$

(In case of under limit)

$$\Delta\theta = 0$$

$K_{SL}$ is a correction gain. $\partial\theta/\partial S$ is an influence coefficient of a looper angle with respect to a roll gap. S is a roll gap. An affixed word "REF" represents a command value. An affixed word "LMT" represents an upper and lower limit value.

According to this embodiment, a width control for a rolled material is efficiently executed without an overshoot, since a roll gap change and an interstand tension change control a width of the rolled material cooperatively.

Further, since loopers are used for an auxiliary interstand tension control in order to support an interstand tension control, a response of an interstand tension control is improved, whereby an efficiency of a width control is improved.

Furthermore, since a roll gap of the rolling stand 2*a* disposed at the most upstream side of the finishing hot rolling mill is kept constant, a disturbance against a width control is decreased, and a precision of a thickness presumption is improved.

A tandem type of a finishing hot rolling mill is described in this embodiment, but this embodiment can be easily adopted for a tandem type of a roughing rolling mill disposed at the entry side of the finishing hot rolling mill.

Various modifications and variations are possible in light of the above teachings. Therefore, it is to be understood that within the scope of the appended claims, the present invention may be practiced otherwise than as specifically described herein.

What is claimed is:

1. A control apparatus for a hot rolling mill having a plurality of rolling stands, comprising:

a roll gap tension controller configured to control a roll gap of one of said rolling stands so that a detected interstand tension value of a rolled material positioned between adjacent rolling stands of said plurality of rolling stands accords with a target interstand tension value thereof; and a tension width controller configured to control a width of said rolled material by correcting said target interstand tension.

2. The control apparatus as recited in claim 1, further comprising:

a speed thickness controller configured to control a speed of rolls of said rolling stands so that a delivery side thickness value of a finished rolled material accords with a target thickness thereof.

3. The control apparatus as recited in claim 1, further comprising:

a looper configured to adjust a tension of said rolled material positioned between said adjacent rolling stands; and a looper position controller configured to control a looper angle so as to accord with a target looper angle thereof.

4. The control apparatus as recited in claim 3, further comprising:

a looper angle compensator configured to control said tension by compensating said target looper angle in order to assist said roll gap tension controller.

5. The control apparatus as recited in claim 1, wherein said roll gap tension controller controls said rolling stands disposed at an upstream side of said hot rolling mill.

6. The control apparatus as recited in claim 1, wherein said roll gap of a rolling stand disposed at a most upstream side is kept constant during the rolling.

7. A method of controlling a hot rolling mill having a plurality of rolling stands which prepares a rolled material having a desired width, said method comprising the steps of:

controlling a roll gap of one of said rolling stands so that a detected interstand tension value of a rolled material positioned between adjacent rolling stands accords with a target interstand tension value thereof; and controlling a width of said rolled material by correcting said target interstand tension value.

8. The control apparatus as recited in claim 1, wherein the roll gap is enlarged and the target interstand tension value is increased cooperatively to narrow the width of the rolled material.

9. The method as recited in claim 7, further comprising:

cooperatively enlarging the roll gap and increasing the target interstand tension value to narrow the width of the rolled material.

10. A control apparatus for a hot rolling mill having a plurality of rolling stands, comprising:

a setter to set a target interstand tension value;

a tension width controller configured to control a width of a rolled material by correcting the target interstand tension value, wherein the tension width controller generates a tension command value based on a first detected width and a second detected width;

a roll gap tension controller to receive the tension command value and to generate a roll gap command value; and a first roll gap controller in communication with a first of said plurality of stands to receive the roll gap command value, wherein the roll gap tension controller is configured to control a roll gap of the first of said rolling stands so that a detected interstand tension value of a rolled material positioned between the first rolling stand and an adjacent rolling stand accords with a target interstand tension value.

11. The control apparatus according to claim 10, wherein the tension width controller comprises:

a tracking circuit to output a width difference value based on the first detected width and a target width;

a feed forward controller to receive the width difference value and generate a first tension modification value; and a tension feed back controller to generate a second tension modification value.

12. The control apparatus according to claim 11, wherein the tension width controller generates a tension correction value, wherein the tension correction value is calculated based on the first tension modification value and the second tension modification value.

13. The control apparatus according to claim 10, wherein the roll gap tension controller comprises:

a dead band circuit to generate a difference value on the basis of a detected interstand tension value and an interstand tension command value; and a roll gap feed back controller to receive the difference value and to generate a roll gap correction value.

14. The control apparatus according to claim 13, further comprising:

a roll gap tension limiter circuit disposed in the roll gap tension controller.

15. The control apparatus according to claim 13, wherein the roll gap tension controller is disposed at an upstream end of the hot rolling mill.

16. The control apparatus according to claim 10, further comprising:

a speed thickness controller configured to control a speed of rolls of said rolling stands so that a delivery side thickness value of a finished rolled material accords with a target thickness.

17. The control apparatus according to claim 16, wherein the speed thickness controller comprises:

a speed thickness feed back controller to generate a speed correction value on the basis of a thickness difference between a presumed thickness value an a target thickness value;

a speed thickness limiter circuit; and a thickness estimator to generate the presumed thickness value on the basis of a detected roll force and the roll gap.

* * * * *